US011073314B2

(12) United States Patent
Christians et al.

(10) Patent No.: US 11,073,314 B2
(45) Date of Patent: Jul. 27, 2021

(54) MULITLEVEL DISTRIBUTION SYSTEM FOR EVAPORATOR

(71) Applicant: Carrier Corporation, Palm Beach Gardens, FL (US)

(72) Inventors: Marcel Christians, Skaneateles, NY (US); Bryce Kirk Moore, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 51 days.

(21) Appl. No.: 15/577,118

(22) PCT Filed: May 24, 2016

(86) PCT No.: PCT/US2016/033913

§ 371 (c)(1),
(2) Date: Nov. 27, 2017

(87) PCT Pub. No.: WO2016/191417

PCT Pub. Date: Dec. 1, 2016

(65) Prior Publication Data

US 2018/0172327 A1 Jun. 21, 2018

Related U.S. Application Data

(60) Provisional application No. 62/166,796, filed on May 27, 2015.

(51) Int. Cl.
*F25B 39/02* (2006.01)
*F28F 9/02* (2006.01)
(Continued)

(52) U.S. Cl.
CPC ..... *F25B 39/028* (2013.01); *F28D 5/02* (2013.01); *F28D 7/16* (2013.01); *F28F 9/0273* (2013.01);
(Continued)

(58) Field of Classification Search
CPC ..... F25B 39/028; F25B 2339/0242; F25B 2339/024; F25B 2339/0241; F28D 5/00;
(Continued)

(56) References Cited

U.S. PATENT DOCUMENTS 2,012,183 A * 8/1935 Carrier ..... F28D 3/04 62/394
2,717,767 A * 9/1955 Cantacuzene ..... F28D 7/1638 165/159
(Continued)

FOREIGN PATENT DOCUMENTS

CN 101907375 A 12/2010
CN 103062962 A 4/2013
(Continued)

OTHER PUBLICATIONS

"At." In The American Heritage(R) Dictionary of the English Language, edited by Editors of the American Heritage Dictionaries. 6th ed. Houghton Mifflin, 2016. https://search.credoreference.com/content/entry/hmdictenglang/at/0?institutionId=743.*
(Continued)

*Primary Examiner* — Tavia Sullens
(74) *Attorney, Agent, or Firm* — Cantor Colburn LLP

(57) ABSTRACT

A falling film evaporator includes a housing and a plurality of evaporator tubes located in the housing. A liquid refrigerant distribution system is positioned in the housing and includes a manifold having a plurality of manifold outlet openings and a baffle positioned between the manifold and a distribution vessel and comprising a plurality of baffle openings. The distribution vessel has a plurality of distribution vessel openings for conveying the liquid refrigerant onto evaporator tubes when in use. A method of operating an evaporator includes conveying a two-phase vapor and liquid refrigerant mixture to a manifold and spraying the mixture out of the manifold through a plurality of manifold openings
(Continued)

toward a distribution vessel. The mixture in impinged on a baffle located between the manifold and the distribution vessel and the liquid refrigerant is separated from the mixture via the impingement. The liquid refrigerant is collected at the distribution vessel.

19 Claims, 4 Drawing Sheets

(51) Int. Cl.
*F28F 25/04* (2006.01)
*F28D 5/02* (2006.01)
*F28D 7/16* (2006.01)
*F28D 21/00* (2006.01)

(52) U.S. Cl.
CPC ..... *F28F 25/04* (2013.01); *F25B 2339/0242* (2013.01); *F28D 2021/0071* (2013.01)

(58) Field of Classification Search
CPC ..... F28D 5/02; F28D 3/00; F28D 3/02; F28D 3/04; F28D 2021/0071; F28D 7/16; F28F 25/087; F28F 25/04; F28F 9/0273
USPC ..... 165/110, 159
See application file for complete search history.

(56) References Cited

U.S. PATENT DOCUMENTS 3,197,387 A * 7/1965 Lawrance ..... B01D 3/065 202/173
4,918,944 A 4/1990 Takahashi et al.
4,944,839 A 7/1990 Rosenblad
5,645,124 A 7/1997 Hartfield et al.
6,089,312 A 7/2000 Biar et al.
6,606,882 B1 8/2003 Gupte
6,688,137 B1 2/2004 Gupte
6,830,099 B2 12/2004 Moeykens
6,868,695 B1 3/2005 Dingel et al.
8,650,905 B2 2/2014 De Larminat et al.
8,863,551 B2 10/2014 De Larminat et al.
2005/0039888 A1 2/2005 Pfahnl et al.
2010/0206535 A1 8/2010 Munoz et al.
2011/0083833 A1 4/2011 Zorzin et al.
2011/0180235 A1 7/2011 Garimella et al.
2012/0018133 A1 1/2012 Postma et al.
2013/0027701 A1 1/2013 Priore et al.
2013/0277018 A1 10/2013 Numata et al.
2014/0150490 A1 6/2014 Kang
2015/0000873 A1 1/2015 Steinbauer et al.
2015/0005337 A1 1/2015 Carrara et al.
2015/0013950 A1 * 1/2015 Numata ..... F25B 39/02 165/157
2015/0053378 A1 2/2015 Numata et al.

FOREIGN PATENT DOCUMENTS

CN 103851839 A 6/2014
CN 104272056 A 1/2015
RU 2178324 C2 1/2002
RU 147398 U1 11/2014

OTHER PUBLICATIONS

International Search Report for International Application No. PCT/US/2016/033913; International Filing Date May 24, 2016; dated Sep. 7, 2016; 5 pages.
Written Opinion for International Application No. PCT/US/2016/033913; International Filing Date May 24, 2016; dated Sep. 7, 2016; 5 pages.

* cited by examiner

MULITLEVEL DISTRIBUTION SYSTEM FOR EVAPORATOR

CROSS REFERENCE TO RELATED APPLICATIONS

This application is a National Stage application of PCT/US2016/033913, filed May 24, 2016, which claims the benefit of U.S. Provisional Application No. 62/166,796, filed May 27, 2015, both of which are incorporated by reference in their entirety herein.

BACKGROUND

The subject matter disclosed herein relates to heating, ventilation, air conditioning, and refrigeration (HVAC&R) systems. More specifically, the subject matter disclosed herein relates to evaporators for HVAC&R systems.

HVAC&R systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes.

Refrigerant liquid flows in the direction of gravity, falls on the evaporator tubes and evaporates. Evaporation is accomplished through thin film evaporation on the surface of the evaporator tubes. A small fraction of the liquid refrigerant is boiled off in a pool boiling section, typically located below the evaporator tubes. Different methods have been implemented to distribute liquid on the falling film tubes using single-phase gravity feed rather than pressure assisted spray through nozzles. An advantage of gravity feed can include lowering the risk of maldistribution and/or dryout on the evaporator tubes. While it provides superior distribution, this method of gravity feed can rely on considerable amounts of piping, both for vapor-liquid separation and for the subsequent distributed liquid flow network. These volumes can be considerable due to their impact on heat exchanger vessel sizes and liquid charge holdup in the distribution system.

BRIEF SUMMARY

In one embodiment a falling film evaporator includes a housing and a plurality of evaporator tubes located at least partially in the housing. A liquid refrigerant distribution system is positioned in the housing and includes a manifold having a plurality of manifold outlet openings and a baffle positioned between the manifold and a distribution vessel and comprising a plurality of baffle openings. The distribution vessel has a plurality of distribution vessel openings for conveying the liquid refrigerant onto the plurality of evaporator tubes when in use.

Additionally or alternatively, in this or other embodiments a sheath at least partially encloses the manifold and the distribution vessel.

Additionally or alternatively, in this or other embodiments the sheath defines a vapor refrigerant flowpath between the sheath and the distribution vessel to allow for exit of the vapor and liquid refrigerant mixture from the distribution vessel.

Additionally or alternatively, in this or other embodiments the baffle extends between the sheath and the distribution vessel.

Additionally or alternatively, in this or other embodiments the manifold comprises a cylinder, wherein the axial dimension of the cylinder is the largest dimension.

Additionally or alternatively, in this or other embodiments the plurality of spray openings are disposed at an angle of 15 to 60 degrees below horizontal.

Additionally or alternatively, in this or other embodiments the baffle comprises a porous momentum barrier.

Additionally or alternatively, in this or other embodiments the plurality of drip openings are configured to maintain a standing liquid refrigerant level in the distribution vessel when in use under full load conditions.

In another embodiment, a heating, ventilation, air conditioning, and refrigeration (HVAC&R) system includes a condenser flowing a flow of refrigerant therethrough and a falling film evaporator in flow communication with the condenser. The falling film evaporator includes a housing, a plurality of evaporator tubes located at least partially in the housing, and a liquid refrigerant distribution system positioned in the housing. The distribution system includes a manifold having a plurality of manifold outlet openings and a baffle located between the manifold and a distribution vessel and comprising a plurality of baffle openings. The distribution vessel has a plurality of distribution vessel openings for conveying the liquid refrigerant onto the plurality of evaporator tubes when in us. A compressor receives a flow of vapor refrigerant from the falling film evaporator.

Additionally or alternatively, in this or other embodiments a sheath at least partially enclosing the manifold and the distribution vessel.

Additionally or alternatively, in this or other embodiments the sheath defines a vapor refrigerant flowpath between the sheath and the distribution vessel to allow for exit of the vapor and liquid refrigerant mixture from the distribution vessel.

Additionally or alternatively, in this or other embodiments the baffle extends between the sheath to the distribution vessel.

Additionally or alternatively, in this or other embodiments the manifold comprises a cylinder, wherein the axial dimension of the cylinder is the largest dimension.

Additionally or alternatively, in this or other embodiments the plurality of spray openings are disposed at an angle of 15 to 60 degrees below horizontal.

Additionally or alternatively, in this or other embodiments the baffle comprises a porous momentum barrier.

Additionally or alternatively, in this or other embodiments the plurality of drip openings are configured to maintain a standing liquid refrigerant level in the distribution vessel when in use under full load conditions.

In yet another embodiment, a method of operating an evaporator includes conveying a two-phase vapor and liquid refrigerant mixture to a manifold and spraying the two-phase vapor and liquid refrigerant mixture out of the manifold through a plurality of manifold openings toward a distribution vessel. The vapor and liquid refrigerant mixture in impinged on a baffle located between the manifold and the distribution vessel and the liquid refrigerant is separated from the vapor and liquid refrigerant mixture via the impingement. The liquid refrigerant is collected at the distribution vessel.

Additionally or alternatively, in this or other embodiments the liquid refrigerant is conveyed through a plurality of distribution vessel openings onto a plurality of evaporator tubes; and Additionally or alternatively, in this or other embodiments thermal energy is exchanged between the liquid refrigerant and a heat transfer fluid flowing through the plurality of evaporator tubes.

Additionally or alternatively, in this or other embodiments the vapor refrigerant is conveyed from the vapor and liquid refrigerant mixture from the distribution vessel via a vapor path defined by a vapor sheath and an evaporator housing.

Additionally or alternatively, in this or other embodiments the spraying further comprises directing the two-phase vapor and liquid refrigerant mixture through the plurality of manifold openings at an angle of 15 degrees to 60 degrees below a horizontal centerline of the manifold.

Additionally or alternatively, in this or other embodiments an average liquid refrigerant height is maintained in the distribution vessel between a first height and a second height, wherein the first height is 50% of the second height.

Additionally or alternatively, in this or other embodiments an average liquid refrigerant height in the distribution vessel is maintained such that the flow rate of the liquid refrigerant through the plurality of distribution vessel openings is substantially uniform.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
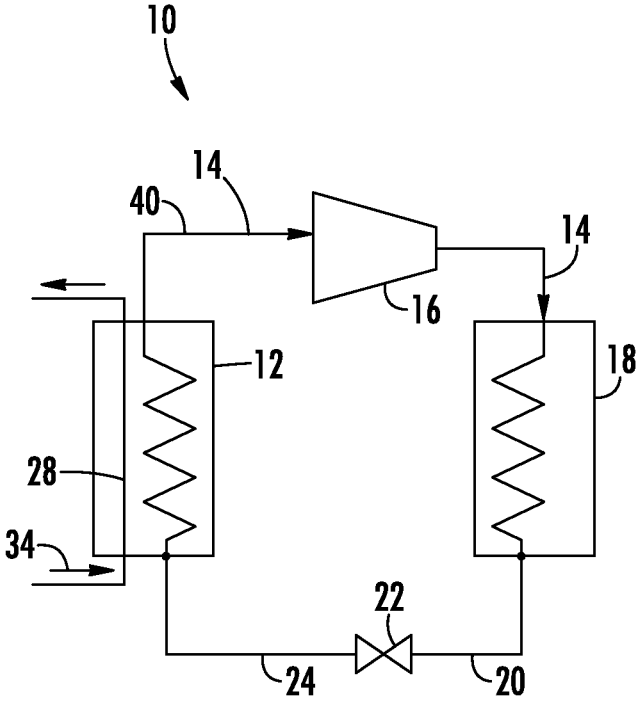
FIG. 1 is a schematic view of an embodiment of a heating, ventilation and air conditioning system.

Shown in FIG. 1 is a schematic view of an embodiment of a heating, ventilation, air conditioning, and refrigeration (HVAC&R) system, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12, from which vapor refrigerant 14 is returned to the compressor 16.

Figure 2:
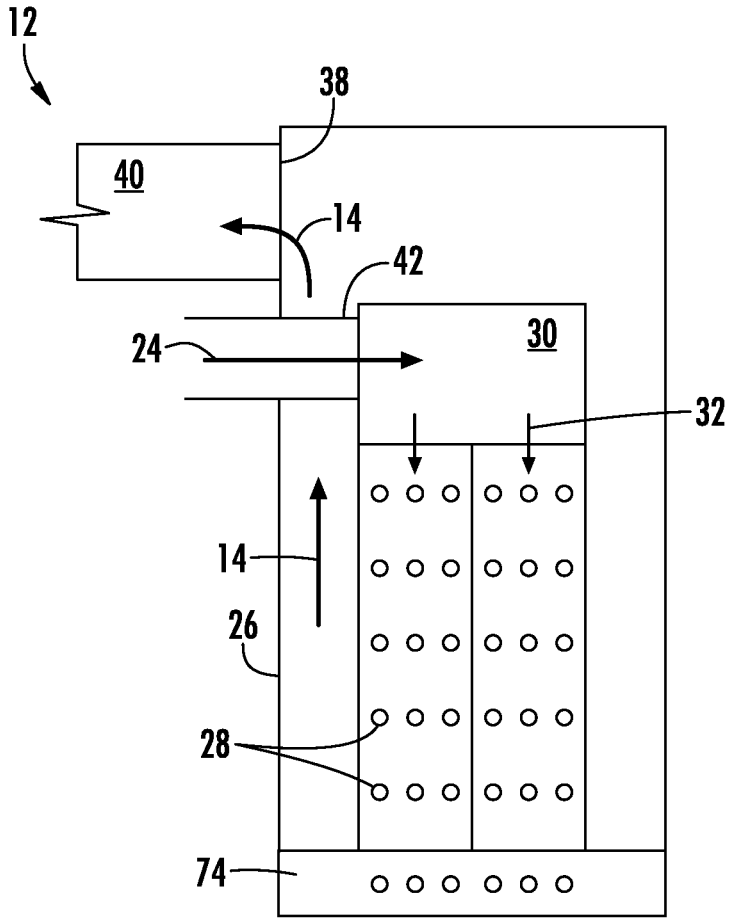
FIG. 2 is a schematic view of an embodiment of a falling film evaporator for an HVAC&R system.

Referring now to FIG. 2, as stated above, the evaporator 12 is a falling film evaporator. The evaporator 12 includes housing 26 with the evaporator 12 components disposed at least partially therein, including a plurality of evaporator tubes 28. A distributor 30 is located above the evaporator tubes 28 to distribute liquid refrigerant 32 over the evaporator tubes 28. A thermal energy exchange occurs between a flow of heat transfer medium 34 (shown in FIG. 1) flowing through the evaporator tubes 28 into and out of the evaporator 12 and the liquid refrigerant 32. As the liquid refrigerant 32 is boiled off in the evaporator 12, the resulting vapor refrigerant 14 is directed to the compressor 16 via a suction nozzle 38 and through a suction line 40.

Figure 3:
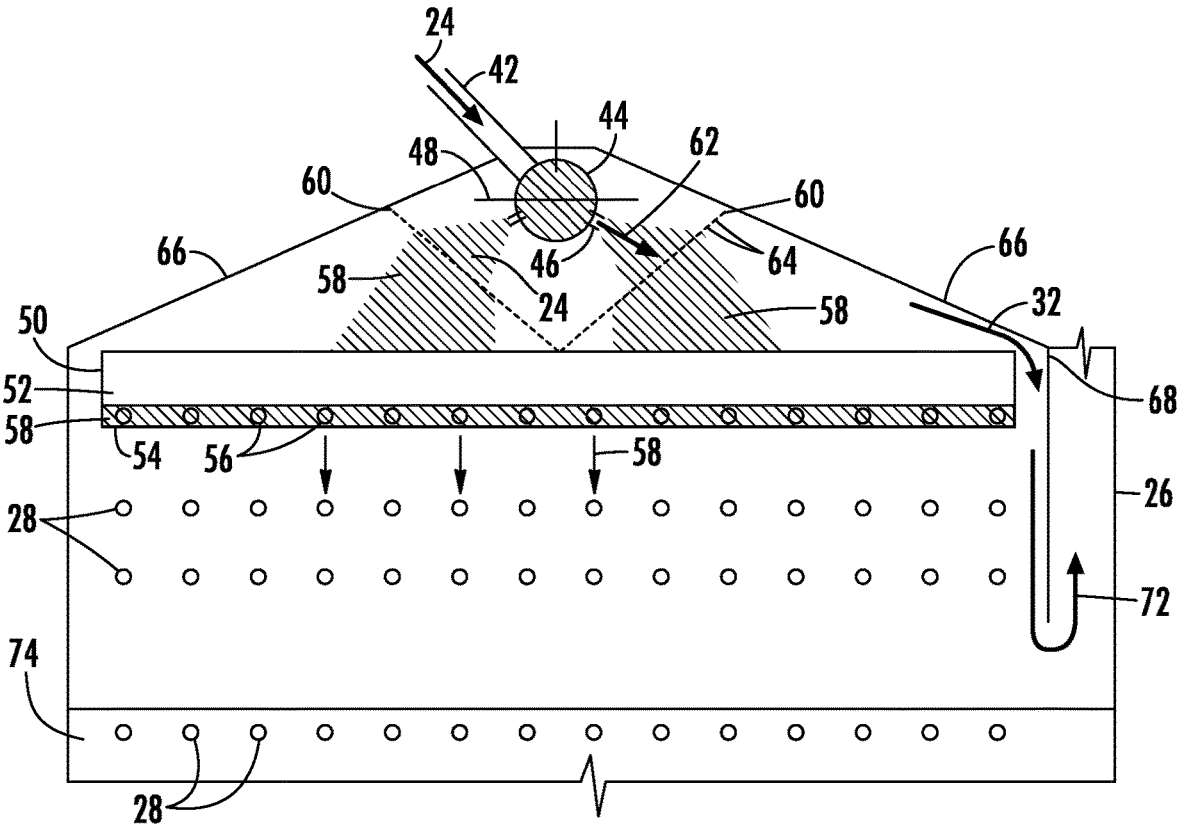
FIG. 3 is a cross-sectional view of an embodiment of a refrigerant distributor for a falling film evaporator.
Figure 4:
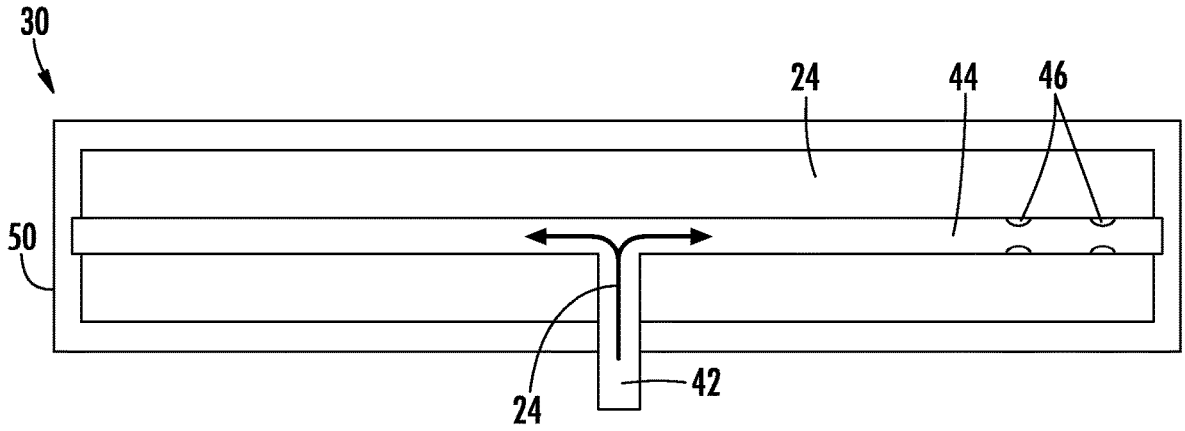
FIG. 4 is a plan view of an embodiment of a refrigerant distributor for a falling film evaporator.
Figure 5:
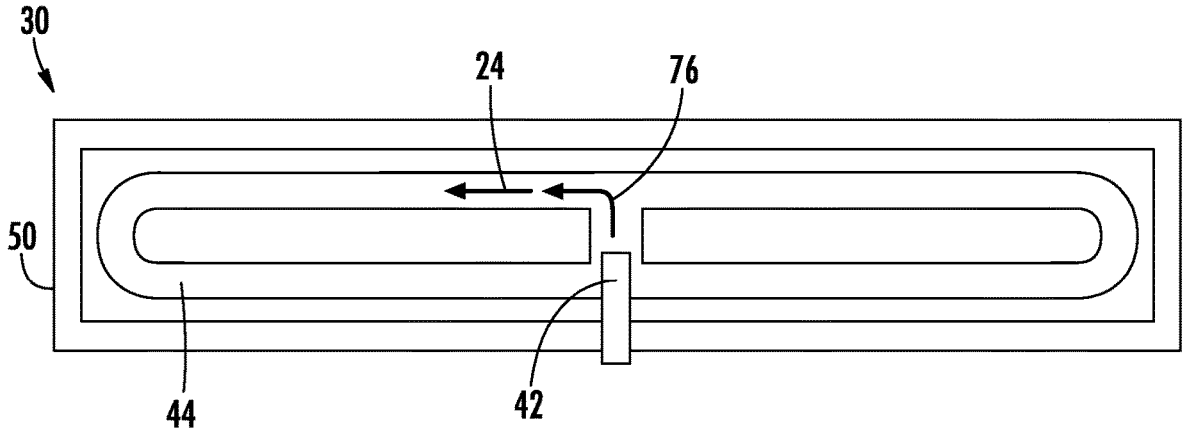
FIG. 5 is a plan view of another embodiment of a refrigerant distributor for a falling film evaporator.

The distributor 30 is illustrated in more detail in FIG. 3. The distributor 30 includes an inlet port 42 through which the vapor and liquid refrigerant mixture 24 enters the distributor 30. The inlet port 42 directs the vapor and liquid refrigerant mixture 24 into a two-phase manifold pipe 44. The manifold pipe 44, located in the distributor 30, may be of any suitable cross-sectional shape, including circular as shown in FIG. 3, elliptical, or polygonal with straight and/or curved sides. The manifold pipe 44 extends along a length and width, both horizontal dimensions, of the distributor 30, as shown in FIGS. 4 and 5. The manifold pipe 44 extends at least partially over the plurality of evaporator tubes 28. For example, the largest cross-sectional extent of the manifold pipe 44 can project onto the plurality of evaporator tubes 28 coincident with 10% to 100% of the area of the plurality of evaporator tubes 28 (e.g., the area of the plurality of evaporator tubes 28 as taken from a top view). Referring again to FIG. 3, the manifold pipe 44 includes a plurality of spray orifices 46 arranged along the manifold pipe 44 (please indicate that the arrangement of the orifices can be in any pattern). The spray orifices 46 may be arranged in any pattern along the manifold pipe 44, for example, one or more lengthwise-extending rows, staggered rows, curvilinear or polygonal orifice patterns or the like. For example, one embodiment, as shown, utilizes two lengthwise-extending rows of spray orifices 46. The spray orifices 46 may be uniform in size, or alternatively may vary in size. Further, the spray orifices 46 may be of any suitable shape including, but not limited to, circular, elliptical, polygonal or the like. The plurality of spray orifices 46 are arranged to convey the refrigerant mixture 24 downward toward a distribution vessel 50, with the plurality of spray orifices 46 located at a position below horizontal relative to a center of the cross-section of the manifold pipe 44, as represented at 48. In some embodiments, the plurality of spray orifices 46 are located at about 15 degrees to 60 degrees below horizontal, while in other embodiments, the plurality of spray orifices 46 may be located at, for example, between 10 degrees and 70 degrees or between 5 degrees and 90 degrees relative to horizontal. The spray orifices 46 are sized and arranged for proper function of the manifold pipe 44, so refrigerant mixture 24 remains distributed through the manifold pipe 44 while preventing uncontrolled sputtering of the refrigerant mixture 24 out of the spray orifices 46.

As stated above, the refrigerant mixture 24 is sprayed toward a distribution vessel 50. The distribution vessel 50 includes box ends 52 and an orifice plate 54 forming a bottom face of the distribution vessel 50. The orifice plate 54 includes a plurality of orifices 56 arranged over the bundle of evaporator tubes 28 below. The orifices 56 are sized and spaced such that, at full load conditions, there is a standing liquid refrigerant 58 level, thus using gravity to achieve substantially uniform flow rate of liquid refrigerant 58 through the orifice plate 54 and over the evaporator tubes 28. The height of the standing liquid refrigerant 58 level can vary during operation, but the orifices can be sized such that during steady load the flow rate of liquid refrigerant therethrough can be substantially uniform (e.g., all flow rates through the plurality of orifices are within 85% to 115% of the average flow rate through the plurality of orifices during full, steady state load). As such, the orifices 56 may be of any suitable shape, for example, circular, elliptical or polygonal, or may be configured as slots in the orifice plate 56. Further, the orifices 56 may be arranged in any suitable pattern, for example, in rows, with each row directly above and extending along a length of a particular evaporator tube 28 of the plurality of evaporator tubes 28.

A baffle 60 can be positioned between the spray orifices 46 and the distribution vessel 50. The baffle 60 can be positioned to be substantially perpendicular to a direction of spray 62 from the spray orifices 46. The baffle 60 can be a planar sheet. The baffle 60 may include a plurality of openings 64. The plurality of openings 64 may be of any shape, for example, circular holes or elongated slots. The baffle 60 or portions thereof can include another type of porous momentum barrier, such as a mesh screen. Any combination of the aforementioned baffle constructions is possible, such as a planar baffle including a plurality of circular shaped openings.

A vapor sheath 66 is positioned over the manifold pipe and the distribution vessel 50 such that, in some embodiments, the baffle 60 extends between the vapor sheath 66 and the distribution vessel 50. The vapor sheath 66 defines a vapor path 68 between the vapor sheath 66 and the distribution vessel end 52.

In operation, the two-phase vapor and liquid refrigerant mixture 24 enters the manifold pipe 44 through the inlet port 42. The vapor and liquid refrigerant mixture 24 accumulates in the manifold pipe 44 and is sprayed out of the spray orifices 46. The sprayed vapor and liquid refrigerant mixture 24 impinges on the baffle 60, and passes therethrough, reducing a kinetic energy of the liquid refrigerant 58 portion of the vapor liquid refrigerant mixture 24 such that standing waves and dynamic disturbances produced by downward flow of the liquid refrigerant 58 do not result in significant local deviations in flow rates through the orifices 56 of the orifice plate 54. Such unwanted level disturbances and flow rate deviations can result in flow imbalances from the orifices 56 or dry spots over the surface of the orifice plate 54. The liquid refrigerant 58 settles into the distribution vessel 50 and passes through the plurality of orifices 56 and over the plurality of evaporator tubes 28. After passing through the baffles 60, vapor refrigerant 72 from the vapor and liquid refrigerant mixture 24 exits the distributor 30 through the vapor path 68, making its way between the vapor sheath 66 and the housing 26 and to the suction nozzle 38 (shown in FIG. 2) for return to the compressor 16. The vapor path 68 increases the likelihood that liquid droplets carried out of the distribution system must impinge either on the sheath 66, the evaporator tubes 28 or a liquid surface in a pool boiling section 74 of the evaporator. This can reduce the likelihood that unwanted liquid refrigerant 58 mass will enter the suction nozzle 38 in comparison to other evaporator systems. Correspondingly, the portion of the liquid refrigerant 58 that is evaporated inside of the evaporator 12 can be increased in comparison to other evaporator systems.

Referring now to FIG. 5, in an embodiment, the manifold pipe 44 can include an elliptical path. This can be especially advantageous in applications where an available pressure drop is insufficient to maintain an even flow rate from the spray orifices 46 along a length of the manifold 44. The inlet port 42 is configured to convey the vapor and liquid refrigerant mixture 24 into the manifold 44 coaxial with a flow direction 76 of the vapor and liquid refrigerant mixture 24 in the manifold 44. A momentum of high velocity flow through the inlet port 42 is added to the recirculating stream of vapor and liquid refrigerant mixture 24, thus providing more uniform flow conditions inside of the manifold 44 and also allows for more even axial distribution of refrigerant from the spray orifices 46, due to the two (or more) pass design.

The distributor of the present disclosure retains flow metering benefits of gravity feed through the orifice plate 54, while eliminating the large upstream refrigerant volumes and vessel size requirements that can be characteristic of other vapor-liquid separator and liquid refrigerant piping constructions. This can reduce the overall refrigerant charge of the system and can correspondingly allow for reduced cost and complexity.

In one embodiment a falling film evaporator includes a housing and a plurality of evaporator tubes located at least partially in the housing. A liquid refrigerant distribution system is positioned in the housing and includes a manifold having a plurality of manifold outlet openings and a baffle positioned between the manifold and a distribution vessel and comprising a plurality of baffle openings. The distribution vessel has a plurality of distribution vessel openings for conveying the liquid refrigerant onto the plurality of evaporator tubes when in use.

Additionally or alternatively, in this or other embodiments a sheath at least partially encloses the manifold and the distribution vessel.

Additionally or alternatively, in this or other embodiments the sheath defines a vapor refrigerant flowpath between the sheath and the distribution vessel to allow for exit of the vapor and liquid refrigerant mixture from the distribution vessel.

Additionally or alternatively, in this or other embodiments the baffle extends between the sheath and the distribution vessel.

Additionally or alternatively, in this or other embodiments the manifold comprises a cylinder, wherein the axial dimension of the cylinder is the largest dimension.

Additionally or alternatively, in this or other embodiments the plurality of spray openings are disposed at an angle of 15 to 60 degrees below horizontal.

Additionally or alternatively, in this or other embodiments the baffle comprises a porous momentum barrier.

Additionally or alternatively, in this or other embodiments the plurality of drip openings are configured to maintain a standing liquid refrigerant level in the distribution vessel when in use under full load conditions.

In another embodiment, a heating, ventilation, air conditioning, and refrigeration (HVAC&R) system includes a condenser flowing a flow of refrigerant therethrough and a falling film evaporator in flow communication with the condenser. The falling film evaporator includes a housing, a plurality of evaporator tubes located at least partially in the housing, and a liquid refrigerant distribution system positioned in the housing. The distribution system includes a manifold having a plurality of manifold outlet openings and a baffle located between the manifold and a distribution vessel and comprising a plurality of baffle openings. The distribution vessel has a plurality of distribution vessel openings for conveying the liquid refrigerant onto the plurality of evaporator tubes when in us. A compressor receives a flow of vapor refrigerant from the falling film evaporator.

Additionally or alternatively, in this or other embodiments a sheath at least partially enclosing the manifold and the distribution vessel.

Additionally or alternatively, in this or other embodiments the sheath defines a vapor refrigerant flowpath between the sheath and the distribution vessel to allow for exit of the vapor and liquid refrigerant mixture from the distribution vessel.

Additionally or alternatively, in this or other embodiments the baffle extends between the sheath to the distribution vessel.

Additionally or alternatively, in this or other embodiments the manifold comprises a cylinder, wherein the axial dimension of the cylinder is the largest dimension.

Additionally or alternatively, in this or other embodiments the plurality of spray openings are disposed at an angle of 15 to 60 degrees below horizontal.

Additionally or alternatively, in this or other embodiments the baffle comprises a porous momentum barrier.

Additionally or alternatively, in this or other embodiments the plurality of drip openings are configured to maintain a standing liquid refrigerant level in the distribution vessel when in use under full load conditions.

In yet another embodiment, a method of operating an evaporator includes conveying a two-phase vapor and liquid refrigerant mixture to a manifold and spraying the two-phase vapor and liquid refrigerant mixture out of the manifold through a plurality of manifold openings toward a distribution vessel. The vapor and liquid refrigerant mixture in impinged on a baffle located between the manifold and the distribution vessel and the liquid refrigerant is separated from the vapor and liquid refrigerant mixture via the impingement. The liquid refrigerant is collected at the distribution vessel.

Additionally or alternatively, in this or other embodiments the liquid refrigerant is conveyed through a plurality of distribution vessel openings onto a plurality of evaporator tubes; and Additionally or alternatively, in this or other embodiments thermal energy is exchanged between the liquid refrigerant and a heat transfer fluid flowing through the plurality of evaporator tubes.

Additionally or alternatively, in this or other embodiments the vapor refrigerant is conveyed from the vapor and liquid refrigerant mixture from the distribution vessel via a vapor path defined by a vapor sheath and an evaporator housing.

Additionally or alternatively, in this or other embodiments the spraying further comprises directing the two-phase vapor and liquid refrigerant mixture through the plurality of manifold openings at an angle of 15 degrees to 60 degrees below a horizontal centerline of the manifold.

Additionally or alternatively, in this or other embodiments an average liquid refrigerant height is maintained in the distribution vessel between a first height and a second height, wherein the first height is 50% of the second height.

Additionally or alternatively, in this or other embodiments an average liquid refrigerant height in the distribution vessel is maintained such that the flow rate of the liquid refrigerant through the plurality of distribution vessel openings is substantially uniform.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A method of operating an evaporator comprising:

conveying a two-phase vapor and liquid refrigerant mixture to a manifold;

spraying the two-phase vapor and liquid refrigerant mixture out of the manifold through a plurality of manifold openings toward a distribution vessel, the plurality of manifold outlet openings disposed below horizontal relative to a center of a cross-section of the manifold;

impinging the two-phase vapor and liquid refrigerant mixture on a baffle located between the plurality of manifold outlet openings and the distribution vessel, the baffle having a first baffle leg and second baffle leg each extending from a vapor sheath toward the distribution vessel, the first baffle leg and the second baffle leg disposed at opposing sides of the manifold, a baffle distance between the first baffle leg and the second baffle leg increasing with increasing distance from the distribution vessel, the first baffle leg intersecting the second baffle leg and the distribution vessel at a common point of the distribution vessel, the first baffle leg and the second baffle leg each positioned perpendicular to a flow of the liquid refrigerant from the plurality of manifold openings;

separating the liquid refrigerant from the vapor and liquid refrigerant mixture via the impingement; and collecting the liquid refrigerant at the distribution vessel.

2. The method of claim 1, further comprising conveying the liquid refrigerant through a plurality of distribution vessel openings onto a plurality of evaporator tubes.

3. The method of claim 2, further comprising exchanging thermal energy between the liquid refrigerant and a heat transfer fluid flowing through the plurality of evaporator tubes.

4. The method of claim 2, further comprising maintaining an average liquid refrigerant height in the distribution vessel such that a flow rate of the liquid refrigerant through each distribution vessel opening of the plurality of distribution vessel openings is substantially uniform.

5. The method of claim 1, further comprising conveying the vapor refrigerant from the vapor and liquid refrigerant mixture from the evaporator via a vapor path defined by the vapor sheath and an evaporator housing.

6. The method of claim 1, wherein the spraying further comprises directing the two-phase vapor and liquid refrigerant mixture through the plurality of manifold openings disposed at an angle of 15 degrees to 60 degrees below a horizontal centerline of the manifold.

7. The method of claim 1, further comprising maintaining an average liquid refrigerant height in the distribution vessel between a first height and a second height, wherein the first height is 50% of the second height.

8. A falling film evaporator comprising:

a housing:

a plurality of evaporator tubes disposed at least partially in the housing; and a liquid refrigerant distribution system disposed in the housing including:

a manifold having a plurality of manifold outlet openings, the plurality of manifold outlet openings disposed below horizontal relative to a center of a cross-section of the manifold;

a distribution vessel disposed below and spaced apart from the manifold;

a sheath at least partially enclosing the manifold and the distribution vessel; and a baffle disposed between the plurality of manifold outlet openings and the distribution vessel and comprising a plurality of baffle openings, the baffle having a first baffle leg and second baffle leg each extending from the sheath toward the distribution vessel, the first baffle leg and the second baffle leg disposed at opposing sides of the manifold, a baffle distance between the first baffle leg and the second baffle leg increasing with increasing distance from the distribution vessel, the first baffle leg intersecting the second baffle leg and the distribution vessel at a common point of the distribution vessel;

the distribution vessel having a plurality of distribution vessel openings for conveying the liquid refrigerant onto the plurality of evaporator tubes when in use;

wherein the liquid refrigerant is directed from the plurality of manifold outlet openings toward the baffle and through the plurality of baffle openings and the first baffle leg and the second baffle leg are each positioned perpendicular to a flow of the liquid refrigerant from the plurality of manifold openings.

9. The falling film evaporator of claim 8, further comprising a refrigerant flowpath defined by the sheath and the distribution vessel to direct the vapor and liquid refrigerant mixture from the distribution vessel.

10. The falling film evaporator of claim 8, wherein the manifold comprises a cylinder, wherein the axial dimension of the cylinder is the largest dimension.

11. The falling film evaporator of claim 8, wherein the plurality of manifold outlet openings are disposed at an angle of 15 to 60 degrees below horizontal.

12. The falling film evaporator of claim 8, wherein the baffle comprises a porous momentum barrier.

13. The falling film evaporator of claim 8, wherein the plurality of distribution vessel openings are configured to maintain a standing liquid refrigerant level in the distribution vessel when in use under full load conditions.

14. A heating, ventilation, air conditioning, and refrigeration (HVAC&R) system comprising:

a condenser flowing a flow of refrigerant therethrough;

a falling film evaporator in flow communication with the condenser including:

a housing:

a plurality of evaporator tubes disposed at least partially in the housing; and a liquid refrigerant distribution system disposed in the housing including:

a manifold having a plurality of manifold outlet openings, the plurality of manifold outlet openings disposed below horizontal relative to a center of a cross-section of the manifold;

a distribution vessel disposed below and spaced apart from the manifold;

a sheath at least partially enclosing the manifold and the distribution vessel; and a baffle disposed between the plurality of manifold outlet openings and the distribution vessel and comprising a plurality of baffle openings, the baffle having a first baffle leg and second baffle leg each extending from the sheath toward the distribution vessel, the first baffle leg and the second baffle leg disposed at opposing sides of the manifold, a baffle distance between the first baffle leg and the second baffle leg increasing with increasing distance from the distribution vessel, the first baffle leg intersecting the second baffle leg and the distribution vessel at a common point of the distribution vessel;

the distribution vessel having a plurality of distribution vessel openings for conveying the liquid refrigerant onto the plurality of evaporator tubes when in use; and a compressor to receive a flow of vapor refrigerant from the falling film evaporator;

wherein the liquid refrigerant is directed from the plurality of manifold outlet openings toward the baffle and through the plurality of baffle openings and the first baffle leg and the second baffle leg are each positioned perpendicular to a flow of the liquid refrigerant from the plurality of manifold openings.

15. The HVAC&R system of claim 14, further comprising a refrigerant flowpath defined by the sheath and the distribution vessel to direct the vapor and liquid refrigerant mixture from the distribution vessel.

16. The HVAC&R system of claim 14, wherein the manifold comprises a cylinder, wherein the axial dimension of the cylinder is the largest dimension.

17. The HVAC&R system of claim 14, wherein the plurality of manifold outlet openings are disposed at an angle of 15 to 60 degrees below horizontal.

18. The HVAC&R system of claim 14, wherein the baffle comprises a porous momentum barrier.

19. The HVAC&R system of claim 14, wherein the plurality of distribution vessel openings are configured to maintain a standing liquid refrigerant level in the distribution vessel when in use under full load conditions.

* * * * *